US012059026B2

(12) United States Patent
Cheong et al.

(10) Patent No.: US 12,059,026 B2
(45) Date of Patent: Aug. 13, 2024

(54) SMOKING ARTICLE FILTER AND SMOKING ARTICLE INCLUDING THE SAME

(71) Applicant: KT&G CORPORATION, Daejeon (KR)

(72) Inventors: Bong Su Cheong, Daejeon (KR); Jong Yeol Kim, Daejeon (KR); Jin Chul Yang, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 39 days.

(21) Appl. No.: 17/431,616

(22) PCT Filed: Mar. 8, 2021

(86) PCT No.: PCT/KR2021/002806
§ 371 (c)(1),
(2) Date: Aug. 17, 2021

(87) PCT Pub. No.: WO2021/215649
PCT Pub. Date: Oct. 28, 2021

(65) Prior Publication Data

US 2022/0287360 A1 Sep. 15, 2022

(30) Foreign Application Priority Data

Apr. 22, 2020 (KR) ..... 10-2020-0048511

(51) Int. Cl.
*A24D 3/10* (2006.01)
*A24D 3/04* (2006.01)
(Continued)

(52) U.S. Cl.
CPC ..... *A24D 3/10* (2013.01); *A24D 3/048* (2013.01); *A24D 3/067* (2013.01); *A24D 3/14* (2013.01)

(58) Field of Classification Search
CPC ..... A24D 3/10; A24D 3/048; A24D 3/067; A24D 3/14
See application file for complete search history.

(56) References Cited

U.S. PATENT DOCUMENTS 5,911,224 A * 6/1999 Berger ..... A24D 3/08 131/332
2006/0174901 A1 8/2006 Karles et al.
(Continued)

FOREIGN PATENT DOCUMENTS

CA 3077507 A1 4/2019
CN 102811632 A 12/2012
(Continued)

OTHER PUBLICATIONS

International Search Report for PCT/KR2021/002806 dated Jun. 29, 2021 (PCT/ISA/210).
(Continued)

*Primary Examiner* — Christopher M Rodd
*Assistant Examiner* — Daniel Edward Vakili
(74) *Attorney, Agent, or Firm* — Sughrue Mion, PLLC

(57) ABSTRACT

Provided herein are a smoking article filter and a smoking article including the same. The filter according to some embodiments of the present disclosure includes a filter plug including a filter material and a liquid material added to the filter plug. Here, a molecular weight of a hydrophilic group of the filter material may be larger than or equal to a molecular weight of a hydrophobic group thereof, and in this case, changes in physical properties of the filter due to adding the liquid material may be minimized.

7 Claims, 4 Drawing Sheets

(51) Int. Cl.
*A24D 3/06* (2006.01)
*A24D 3/14* (2006.01)

(56) References Cited

U.S. PATENT DOCUMENTS

| | | | | |
|---|---|---|---|---|
| 2012/0255569 | A1 | 10/2012 | Beard et al. | |
| 2013/0025611 | A1* | 1/2013 | Rushforth | A24D 3/06 131/332 |
| 2013/0139834 | A1 | 6/2013 | Karlsson et al. | |
| 2015/0001148 | A1* | 1/2015 | Pan | A24D 3/08 426/77 |
| 2017/0360087 | A1 | 12/2017 | Papakyrillou | |

FOREIGN PATENT DOCUMENTS

| | | | | |
|---|---|---|---|---|
| EP | 3 632 232 | A1 | 4/2020 | |
| GB | WO 2020/183169 | * | 3/2020 | A24D 3/02 |
| JP | 54-128070 | A | 10/1979 | |
| JP | 2014-509872 | A | 4/2014 | |
| KR | 10-2014-0014772 | A | 2/2014 | |
| KR | 10-1555414 | B1 | 9/2015 | |
| KR | 10-2016-0048061 | A | 5/2016 | |
| KR | 10-2022908 | B1 | 9/2019 | |
| WO | 2019/130154 | A1 | 7/2019 | |
| WO | WO2020/183169 | A1 * | 9/2020 | A24D 1/20 |

OTHER PUBLICATIONS

Extended European Search Report dated Mar. 1, 2022 from the European Patent Office in EP Application No. 21736949.5.
Communication dated Dec. 6, 2021, issued by the Korean Intellectual Property Office in application No. 10-2020-0048511.
Japanese Office Action dated Mar. 14, 2023 issued by Japanese Patent Office in Japanese Application No. 2021-531752.

* cited by examiner

[FIG. 1]
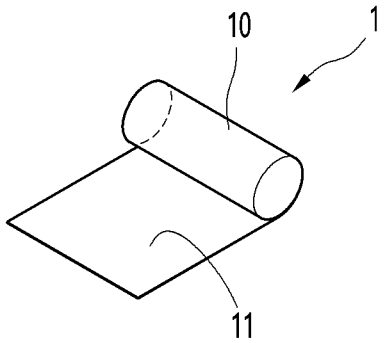
[FIG. 2]
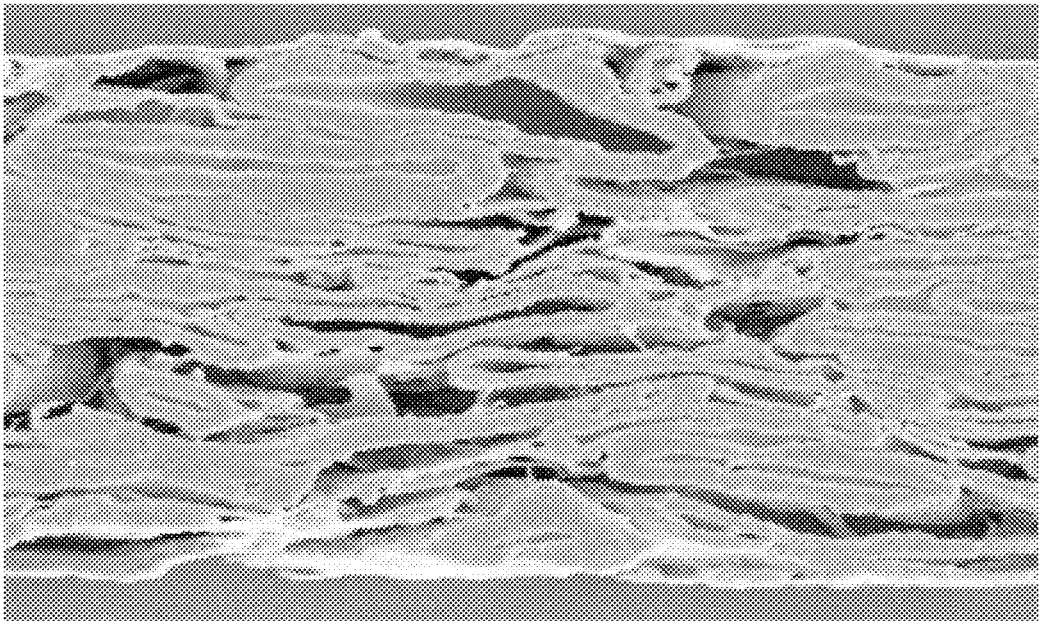

[FIG. 3]
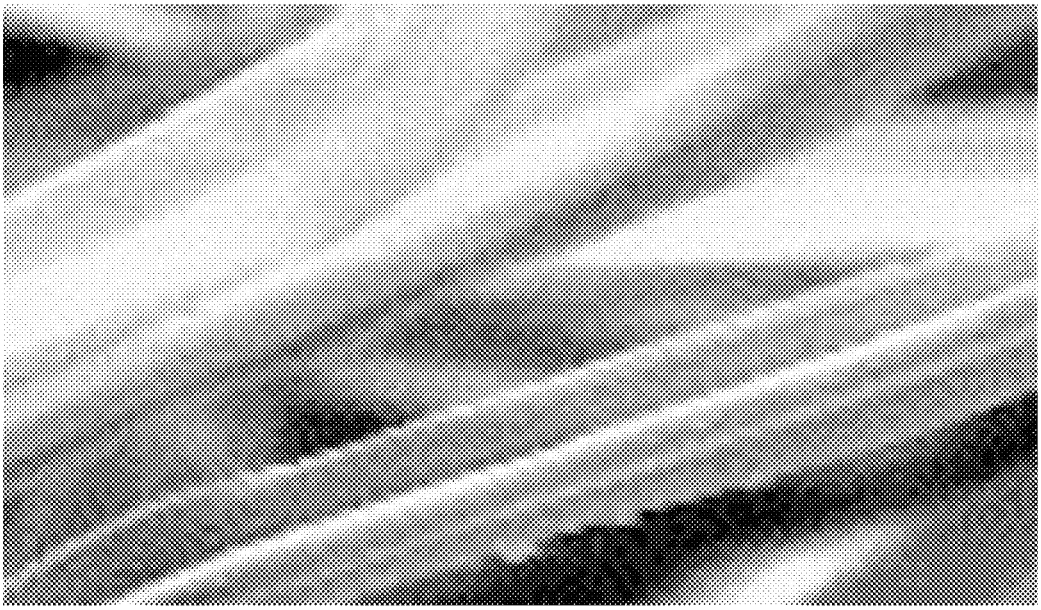
[FIG. 4]
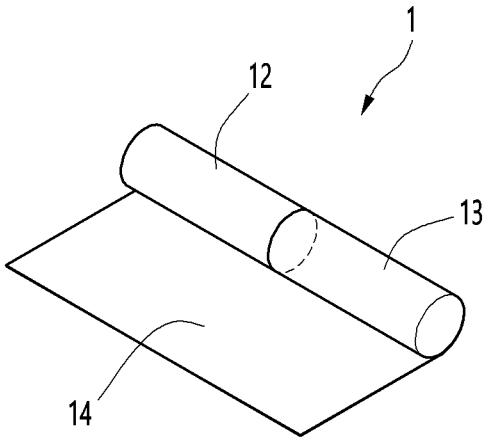

[FIG. 5]
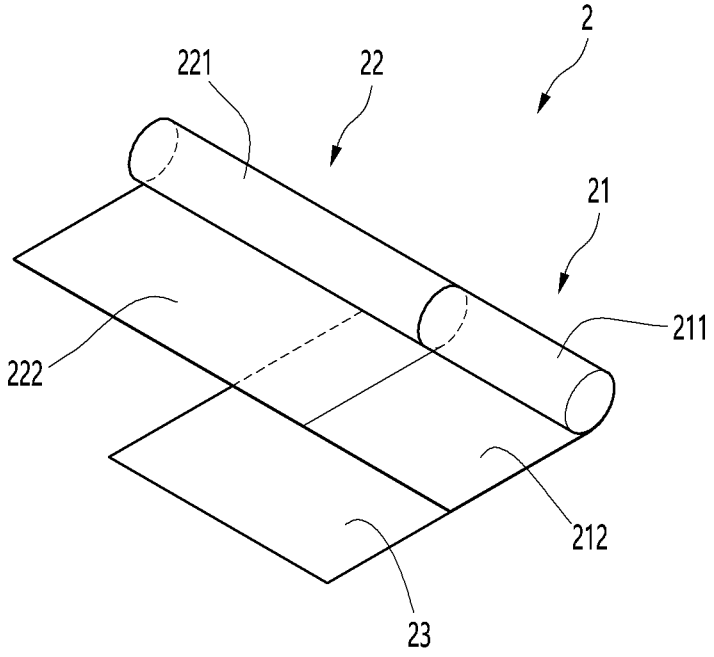

[FIG. 6]
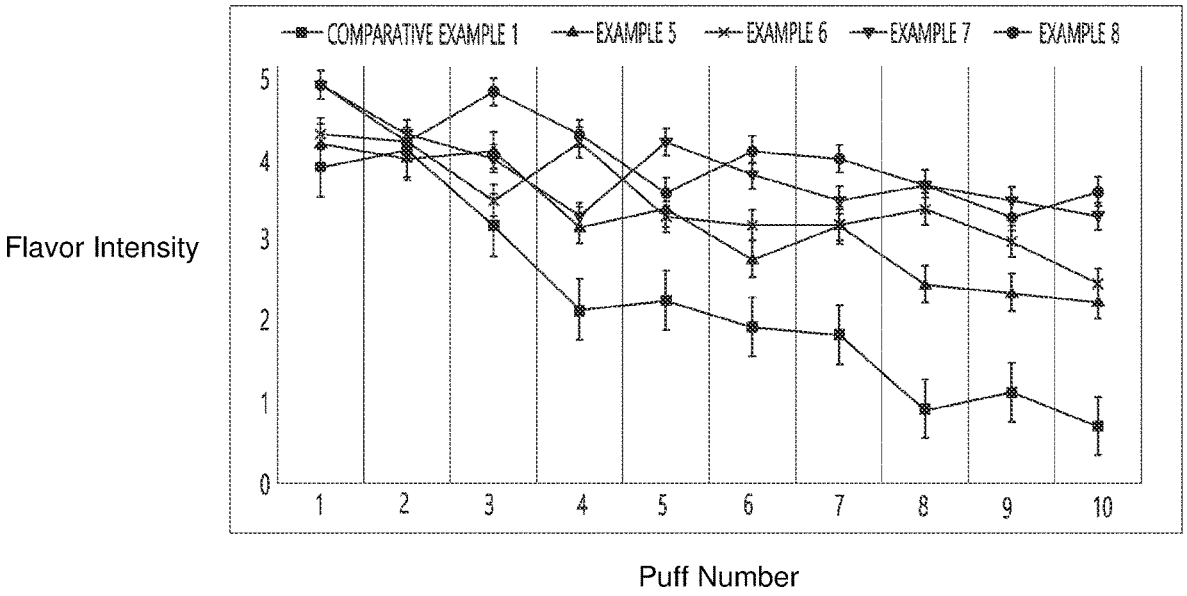

SMOKING ARTICLE FILTER AND SMOKING ARTICLE INCLUDING THE SAME

CROSS REFERENCE TO RELATED APPLICATIONS

This application is a National Stage of International Application No. PCT/KR2021/002806 filed Mar. 8, 2021, claiming priority based on Korean Patent Application No. 10-2020-0048511 filed Apr. 22, 2020.

TECHNICAL FIELD

The present disclosure relates to a smoking article filter and a smoking article including the same.

BACKGROUND ART

To satisfy smokers' preferences, smoking articles (e.g., cigarettes) are flavored in various ways. Directly adding (e.g., spraying) a flavoring liquid to a smoking material or a filter plug constituting a smoking article is a typical example of a flavoring method. However, such methods have a problem in that there is a limit to the amount of flavoring liquid added, an intended flavor is not expressed, or the flavor is rapidly weakened during smoking.

Specifically, in the method in which a flavoring liquid is added to a smoking material, since the flavoring liquid may aggregate with the smoking material, it is difficult to add a large amount of flavoring liquid. Also, an unintended flavor may be expressed due to deterioration of the flavoring liquid caused by a high heating temperature (or burning temperature) during smoking.

Next, in the method in which a flavoring liquid is added to a filter plug, the flavoring liquid may be added in a larger amount as compared to the above method, but there is still a limitation in the amount of flavoring liquid added. This is because, a cellulose acetate fiber, which is a typical filter material constituting the filter plug, is generally manufactured using an extrusion method, and the fiber manufactured in this way does not have a developed pore structure and thus is not able to accommodate a large amount of flavoring liquid. Further, due to its structural characteristics, the cellulose acetate fiber is not able to suppress volatilization of the flavoring liquid, which is penetrated into the pores, well, and in this case, most of the flavoring liquid may be released at an early stage of smoking, and the flavor expressing property may be rapidly weakened as smoking progresses. Also, when an excessive amount of flavoring liquid is added to the cellulose acetate fiber, a problem in which physical properties (e.g., draw resistance, circumference, and the like) of the filter change due to a swelling phenomenon may also occur.

Meanwhile, when the flavoring liquid is added beyond the accommodation limit in any method, a problem in which a wrapper wrapped around the filter plug or smoking material becomes wet and contaminated may occur.

DISCLOSURE

Technical Problem

Some embodiments of the present disclosure are directed to providing a smoking article filter, which is capable of accommodating a large amount of liquid material without causing excessive changes in physical properties thereof, and a smoking article including the same.

Some embodiments of the present disclosure are also directed to providing a smoking article filter with an improved flavor expressing property (intensity of an expressed flavor) and a smoking article including the same.

Some embodiments of the present disclosure are also directed to providing a smoking article filter, which allows a flavor expressing property to be continuously maintained during smoking, and a smoking article including the same.

Objectives of the present disclosure are not limited to the above-mentioned objectives, and other unmentioned objectives should be clearly understood by those of ordinary skill in the art to which the present disclosure pertains from the description below.

Technical Solution

A smoking article filter according to some embodiments of the present disclosure includes a filter plug including a filter material and a liquid material added to the filter plug. Here, the filter material may be a material in which a molecular weight of a hydrophilic group is larger than or equal to a molecular weight of a hydrophobic group.

In some embodiments, the filter material may consist of a plurality of polymerized monomers, and a molecular weight of a hydrophilic group of the monomer may be larger than or equal to a molecular weight of a hydrophobic group thereof.

In some embodiments, the filter material may include a cellulose material whose bulk is higher than or equal to 1.0 $cm^3/g$.

In some embodiments, the filter material may include a cellulose material whose bulk is higher than or equal to 2.0 $cm^3/g$.

In some embodiments, the filter material may include paper.

In some embodiments, a ratio of an entire area of the filter plug to an area of the filter material may be in a range of 2:1 to 20:1.

In some embodiments, when a ratio of the entire area of the filter plug to an area of the cellulose material is 10:1, an added amount of the liquid material may be in a range of 2.0 mg/mm to 8.0 mg/mm.

In some embodiments, the liquid material may be hydrophobic.

In some embodiments, the liquid material may include a medium chain fatty acid triglyceride (MCTG) and a flavoring material.

In some embodiments, the liquid material may include a flavoring material, and the flavoring material may be a material that is present as a crystalline solid at 20° C.

In some embodiments, the liquid material may be a flavoring liquid including a flavoring material, and the flavoring material content of the flavoring liquid may be less than or equal to 50 wt %.

In some embodiments, the liquid material may include menthol as the flavoring material.

Advantageous Effects

According to various embodiments of the present disclosure, a material in which a molecular weight of a hydrophilic group is larger than or equal to a molecular weight of a hydrophobic group can be used as a filter material. In this case, even when a large amount of liquid material (e.g., hydrophobic flavoring liquid) is added, due to a low swelling degree, changes in physical properties of the filter can be minimized.

Also, a cellulose material whose bulk is a reference value or more can be applied to the filter. Since a high-bulk cellulose material has a developed pore structure, the amount of flavoring liquid accommodated in the filter can be significantly increased. Further, since the filter is applied to a smoking article, an intensity of a flavor expressed by the smoking article can be significantly improved. Furthermore, since the high-bulk cellulose material suppresses the rapid volatilization of a flavoring liquid (flavoring material) through its complex pore structure, the flavor persistence of the smoking article can also be improved.

Also, by using a medium chain fatty acid triglyceride (MCTG) as a solvent of a flavoring liquid, the volatilization of a hydrophobic flavoring liquid (i.e., flavoring material) can be better suppressed. In this way, a case where most of the flavor is expressed at an early stage of smoking can be prevented, and thus the flavor persistence of the smoking article can be further improved.

Also, since a flavoring material and a solvent are present at an appropriate ratio, changes in the physical properties of the filter due to adding the flavoring liquid can be further minimized. For example, a problem in which the flavoring material in an oversaturated state is precipitated and crystallized and thus draw resistance of the filter is increased can be prevented.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is an exemplary view schematically illustrating a smoking article filter according to some embodiments of the present disclosure.

FIG. 2 is a cross-sectional view of a cellulose material that may be referenced in various embodiments of the present disclosure.

FIG. 3 is a cross-sectional view of a cellulose acetate fiber which is a type of filter material.

FIG. 4 is an exemplary view schematically illustrating a smoking article filter according to some other embodiments of the present disclosure.

FIG. 5 is an exemplary view schematically illustrating a smoking article including a filter according to some embodiments of the present disclosure.

FIG. 6 illustrates results of sensory evaluation relating to an intensity of an expressed flavor and flavor persistence.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various different forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the possibility of the presence or addition of one or more components, steps, operations, and/or devices other than those mentioned.

First, some terms used in the specification will be clarified.

In the specification, "smoking article" may refer to any product that can be smoked or any product that can provide a smoking experience, regardless of whether the product is based on tobacco, tobacco derivatives, expanded tobacco, reconstituted tobacco, or tobacco substitutes. For example, smoking articles may include products that can be smoked, such as a cigarette, a cigar, and a cigarillo, and tobacco substitutes.

In the specification, "smoking material" may refer to a material that generates smoke and/or an aerosol or is used in smoking. For example, the smoking material may include a tobacco material. For example, the tobacco material may include pieces of tobacco leaves, tobacco stems, and materials obtained by processing the same. As a more specific example, the tobacco material may include ground tobacco leaves, ground reconstituted tobacco, expanded shredded tobacco, expanded tobacco midribs, reconstituted tobacco leaves, and the like.

In the specification, "upstream" or "upstream direction" may refer to a direction moving away from an oral region of a smoker, and "downstream" or "downstream direction" may refer to a direction approaching the oral region of the smoker. The terms "upstream" and "downstream" may be used to describe relative positions of components constituting a smoking article. For example, in a smoking article 2 illustrated in FIG. 5, a filter portion 21 is disposed downstream or in a downstream direction of a smoking material portion 22, and the smoking material portion 22 is disposed upstream or in an upstream direction of the filter portion 21.

Hereinafter, various embodiments of the present disclosure will be described in detail with reference to the accompanying drawings.

FIG. 1 is an exemplary view illustrating a smoking article filter 1 according to some embodiments of the present disclosure.

As illustrated in FIG. 1, the filter 1 may include a filter plug 10 and a filter wrapper 11 wrapped around the same. However, only the components relating to the embodiment of the present disclosure are illustrated in FIG. 1. Therefore, those of ordinary skill in the art to which the present disclosure pertains should understand that the filter 1 may further include general-purpose components other than the components illustrated in FIG. 1. Hereinafter, each component of the filter 1 will be described.

The filter plug 10 may include a filter material and a liquid material. The filter material may include one or more materials having a function of filtering smoke and/or an aerosol. For example, the filter material may include a cellulose material such as paper. For example, the liquid material may include a flavoring liquid in which a flavoring material is dissolved in a solvent. In this case, the filter 1 may be used as a flavoring filter to improve a flavor expressing property of a smoking article (e.g., the smoking article 2 illustrated in FIG. 5). As another example, the liquid material may include a moisturizing material made of glycerin and/or propylene glycol. In this case, the filter 1 may be used as a moisturizing filter to improve vapor production or the like of a smoking article (e.g., the smoking article 2 illustrated in FIG. 5). In addition, the liquid material may consist of various other kinds of materials according to the purpose of the filter 1. Therefore, the scope of the present disclosure is not limited by the above examples. However, hereinafter, for convenience of understanding, description will be continued with the assumption that the liquid material is a flavoring liquid. The liquid material may be added to the filter material by spraying or the like.

The filter plug 10 may have a cylindrical shape, but the scope of the present disclosure is not limited thereto. As necessary, the filter plug 10 may also be manufactured in another shape.

In some embodiments, the filter material may include a cellulose material whose bulk is a reference value or more. For example, the cellulose material may be paper, but the scope of the present disclosure is not limited thereto. The bulk refers to a value obtained by dividing the thickness by the basis weight. A high-bulk cellulose material includes numerous pores therein and thus may accommodate a large amount of flavoring liquid (that is, liquid material). Furthermore, since the high-bulk cellulose material may suppress the rapid volatilization of a volatile flavoring liquid (or flavoring material) through its complex pore structure, the flavor persistence of the filter 1 may also be improved. Further, a problem in which the flavoring material added to the filter 1 is volatilized before smoking (that is, during storage) may also be prevented. For better understanding, additional description will be given with reference to FIGS. 2 and 3.

FIGS. 2 and 3 illustrate pictures of cross-sections of paper and a cellulose acetate fiber, respectively, that are taken using a scanning electron microscope (SEM). As illustrated in FIG. 2, paper whose bulk is a reference value or more includes a plurality of pores in the Z-axis direction (i.e., thickness direction). On the other hand, in the cellulose acetate fiber (see FIG. 3), since pores are not developed in the fiber itself, the fiber can only accommodate a small amount of flavoring liquid and is not able to suppress the volatilization of the flavoring liquid well.

The bulk value of the cellulose material may be changed on the basis of a target porosity (or target flavoring liquid accommodation amount) of the cellulose material, and may be, preferably, higher than or equal to about 1 $cm^3/g$. More preferably, the bulk of the cellulose material may be higher than or equal to about 2 $cm^3/g$, 2.5 $cm^3/g$, or 3.0 $cm^3/g$. Within such numerical ranges, the amount of flavoring liquid accommodated in the cellulose material may be significantly increased. The flavoring liquid accommodation amount will be further described below by referring to Experimental Example 1.

In some embodiments, the filter material may be a material in which a molecular weight of a hydrophilic group is larger than or equal to a molecular weight of a hydrophobic group. For example, in a case in which the filter material consists of a plurality of polymerized monomers, the filter material may be a material in which a molecular weight of a hydrophilic group of each monomer is larger than or equal to a molecular weight of a hydrophobic group thereof or a material in which a molecular weight of a hydrophilic group of all the monomers (e.g., the sum of the molecular weights of hydrophilic groups of individual monomers) is larger than or equal to a molecular weight of a hydrophobic group thereof. An example of such a material may be a hydrophilic cellulose material. However, the scope of the present disclosure is not limited thereto.

The hydrophilic cellulose material may be effective for a hydrophobic flavoring liquid. This is because, unlike the cellulose acetate fiber, the hydrophilic cellulose material does not swell due to the hydrophobic flavoring liquid. More specifically, the cellulose acetate fiber (i.e., tow), which is a material in which cellulose is substituted with acetyl groups. The cellulose acetate fiber is a non-hydrophilic material in which a degree of substitution is about 2.45. When a flavoring liquid having a similar property (e.g., hydrophobicity) is added, the cellulose acetate fiber may swell and adversely affect the physical properties of the filter plug 10 (e.g., draw resistance may increase). However, since the hydrophilic cellulose material hardly swells even when a large amount of hydrophobic flavoring liquid is added thereto, changes in the physical properties of the filter plug 10 due to the flavoring liquid may be prevented. For example, differences in the physical properties, such as the circumference and draw resistance, of the filter plug 10 before and after addition of the flavoring liquid may be insignificant. The changes in the physical properties of the filter plug 10 will be further described below by referring to Experimental Examples 2 and 3.

An example of the hydrophilic cellulose material may be paper. However, the scope of the present disclosure is not limited thereto. In some embodiments, at least a portion of the filter plug 10 may be formed by folding or rolling up the paper in the form of a sheet, but the scope of the present disclosure is not limited thereto.

Meanwhile, preferably, a ratio of an entire area of the filter plug 10 to an area of the cellulose material may be in a range of about 2:1 to 20:1. More preferably, the ratio may be in a range of about 2:1 to 10:1, 2:1 to 9:1, 2:1 to 8:1, or 3:1 to 7:1. Alternatively, the ratio may be in a range of about 2:1 to 7:1, 3:1 to 6:1, 2:1 to 5:1, or 3:1 to 5:1. The area ratio is related to the cellulose material content of the filter plug 10, and when the cellulose material content is too low, the amount of accommodated flavoring liquid may be decreased. Conversely, when the cellulose material content is too high, other content may decrease, and the performance of the filter 1 may be degraded. Therefore, it may be preferable that the ratio of the entire area of the filter plug 10 to the area of the cellulose material falls within the above-listed numerical ranges.

The flavoring liquid added to the filter plug 10 may consist of a solvent and a flavoring material. Examples of the solvent may include propylene glycol (hereinafter abbreviated as "PG") and a medium chain fatty acid triglyceride (hereinafter abbreviated as "MCTG"). However, the scope of the present disclosure is not limited to such examples. PG is a polar (or hydrophilic) solvent and thus may be effective when the flavoring material is polar (or hydrophilic), and MCTG is a non-polar (or hydrophobic) solvent and thus may be effective when the flavoring material is non-polar (or hydrophobic). This is because the non-polar MCTG may allow the non-polar flavoring material to easily dissolve therein and may also suppress the volatilization of the volatile flavoring material well. For example, when the flavoring material is menthol, MCTG may be effective as a solvent. In this case, MCTG may suppress the volatilization of menthol and prevent the intensity of the expressed menthol flavor from rapidly decreasing during smoking. That is, a problem in which the menthol flavor is excessively expressed at an early stage of smoking and not expressed well after an intermediate stage of smoking may be alleviated.

The flavoring material may include any material capable of expressing a flavor, such as menthol. Therefore, the scope of the present disclosure is not limited to specific kinds of flavoring materials.

In some embodiments, the flavoring material may be a material (e.g., L-menthol) that is present as a crystalline solid at room temperature (e.g., 20+5° C.). In this case, a content ratio between a solvent and a flavoring material may be important. This is because, when the solvent content is low, the flavoring material may be precipitated in a solid phase in the filter material and cause the draw resistance, hardness, or the like of the filter plug 10 to rapidly increase. In the embodiment, preferably, the flavoring material content may be less than or equal to about 60 wt %. More preferably, the flavoring material content may be less than or equal to about 50 wt % or 40 wt %. Changes in the physical properties of the filter plug 10 were found to be minimized within the above numerical ranges. This will be further described below by referring to Experimental Examples 2 and 3.

Meanwhile, the amount of added flavoring liquid may vary according to the content (or area) of the cellulose material in the filter plug 10, and may be, preferably, in a range of about 1.0 mg/mm to 9.0 mg/mm or 2.0 mg/mm to 8.0 mg/mm. More preferably, the amount of added flavoring liquid may be in a range of about 2.0 mg/mm to 7.0 mg/mm, 3.0 mg/mm to 7.0 mg/mm, 3.0 mg/mm to 6.0 mg/mm, or 2.0 mg/mm to 6.0 mg/mm. Within such numerical ranges, the flavor expressing property may be increased, a problem in which the wrapper gets wet may be minimized, and a problem in which an excessively strong flavor is expressed during smoking causing the smoker to feel aversion may be prevented.

Meanwhile, in some embodiments, the filter plug 10 may further include one or more other materials widely known in the art. For example, the filter plug 10 may include an adsorbent including carbon, activated carbon, and the like.

Next, the filter wrapper 11 may refer to a wrapper wrapped around the filter plug 10. The filter wrapper 11 may be manufactured with paper having an appropriate basis weight, but the basis weight, material, or the like of the filter wrapper 11 may also be changed.

In some embodiments, a grease-resistant film (not illustrated) having a grease-resistant property may be laminated on the filter wrapper 11. Here, the grease-resistant film may be, for example, a cellulose film, but the scope of the present disclosure is not limited thereto. The grease-resistant film may be attached by an aqueous adhesive to prevent an adhesive strength thereof from decreasing due to a flavoring liquid having an oily property (that is, a hydrophobic flavoring liquid). According to the embodiment, even when the flavoring liquid having an oily property (e.g., hydrophobicity) is added in an excessive amount, contamination of the filter wrapper 11 or a tipping paper (not illustrated) wrapped around the same may be prevented.

Meanwhile, physical specifications, such as the structure, diameter, and length, of the filter 1 or filter plug 10 described above may be designed in various ways in consideration of a smoking article to which the filter 1 or filter plug 10 will be applied. For example, as illustrated in FIG. 4, the filter 1 may have a double filter structure or a multi-filter structure that includes a first filter portion 12 and a second filter portion 13 and may further include a cavity formed between the plurality of filter portions. The first filter portion 12 and the second filter portion 13 may be wrapped in a filter wrapper 14, which may be the same as the filter wrapper 11. Also, to further improve the flavor expressing property of the smoking article, a capsule containing a flavoring liquid may be disposed in the cavity. In a case in which the filter 1 has the multi-filter structure, one or more filter portions of the plurality of filter portions may be manufactured on the basis of cellulose acetate fibers. In this way, while the flavor expressing property of the filter 1 is improved, high filter performance may also be secured.

The smoking article filter 1 according to some embodiments of the present disclosure has been described above with reference to FIGS. 1 to 4. According to the above description, by applying a cellulose material whose bulk is a reference value or more, the amount of flavoring liquid accommodated in the filter plug 10 (that is, the amount of liquid accommodated therein) may be significantly increased. Also, since a high-bulk cellulose material may suppress the rapid volatilization of the flavoring liquid (flavoring material) through its complex pore structure, the flavor persistence of the filter 1 may also be improved.

The above-described filter 1 may be combined with a smoking material rod to constitute a smoking article. The smoking article may be an article that generates smoke and/or an aerosol by burning or may be an article that is inserted into an electronic device to generate smoke and/or an aerosol by electrical heating. Hereinafter, an example of a smoking article including the filter 1 will be described.

FIG. 5 is an exemplary view schematically illustrating a smoking article 2 according to some embodiments of the present disclosure.

As illustrated in FIG. 5, the smoking article 2 may include a filter portion 21 and a smoking material portion 22. However, only the components relating to the embodiment of the present disclosure are illustrated in FIG. 5. Therefore, those of ordinary skill in the art to which the present disclosure pertains should understand that the smoking article 2 may further include general-purpose components other than the components illustrated in FIG. 5.

The filter portion 21 may be disposed downstream of the smoking material portion 22 and serve as a filter for smoke and/or an aerosol generated in the smoking material portion 22. The smoke and/or aerosol that passed through the filter portion 21 may be inhaled into the oral region of the smoker. The filter portion 21 may correspond to the filter 1 described above.

The filter portion 21 may include a filter plug 211 and a filter wrapper 212 wrapped around the same. Also, the filter portion 21 may be connected to an end portion of the smoking material portion 22. For example, the filter portion 21 and the smoking material portion 22 may have a cylindrical shape and aligned in the longitudinal axis direction, and the smoking material portion 22 may be disposed at an upstream end portion of the filter portion 21. The filter portion 21 and the smoking material portion 22 may be connected by a tipping wrapper 23, but the scope of the present disclosure is not limited thereto.

FIG. 5 illustrates an example in which the filter portion 21 consists of a single filter, but the scope of the present disclosure is not limited thereto. The filter portion 21 may also consist of multiple filters and include a cavity formed between the multiple filters.

In some embodiments, a capsule (not illustrated) containing a flavoring liquid therein may be included inside the filter portion 21 to further enhance the flavor or taste of the smoking article 2. For example, the capsule may be disposed in the cavity. The capsule may have a structure in which the flavoring liquid is wrapped by a film. For example, the capsule may have a spherical or cylindrical shape. Materials forming the film of the capsule may be a natural material, starch, and/or a gellant. For example, a film made of a natural material may be composed of agar, pectin, sodium alginate, glycerin, and the like. Gellan gum or gelatin may be used as the gellant. Also, a gelation auxiliary agent may be further used as a material forming the film of the capsule. As the gelation auxiliary agent, for example, calcium chloride may be used. Also, a plasticizer may be further used as a material forming the film of the capsule. Here, as the plasticizer, glycerin and/or sorbitol may be used. Also, a coloring agent may be further used as a material forming the film of the capsule.

In some embodiments, a grease-resistant film or an aluminum foil may be attached to an inner side surface of the filter wrapper 212.

Next, the smoking material portion 22 may include a smoking material 221 and a wrapper 222 wrapped around the same. The smoking material 221 may generate smoke and/or an aerosol as the smoking material 221 is heated. The smoking material portion 22 may be implemented as a smoking material rod having an elongated cylindrical shape, but the scope of the present disclosure is not limited thereto.

In some embodiments, the smoking material 221 may include raw tobacco leaves, reconstituted tobacco leaves, or a mixture of tobacco leaves and reconstituted tobacco leaves. The mixture may be filled in the form of a sheet or shredded tobacco in the smoking material portion 22.

Also, in some embodiments, the smoking material 221 may include at least one aerosol-generating material among glycerin, propylene glycol, ethylene glycol, dipropylene glycol, diethylene glycol, triethylene glycol, tetraethylene glycol, and oleyl alcohol.

Also, in some embodiments, the smoking material 221 may contain other additives such as a flavoring agent, a wetting agent, and/or an acetate compound. For example, the flavoring agent may include licorice, saccharose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, caraway, cognac, jasmine, chamomile, menthol, cinnamon, ylang-ylang, sage, spearmint, ginger, cilantro, coffee, clove material (e.g., clove powder, clove extract), or the like. Also, the wetting agent may include glycerin, propylene glycol, or the like.

Also, in some embodiments, the smoking material 221 may include a reconstituted tobacco material which is formed in the shape of a rod or the like by grinding raw tobacco leaves and reconstituted tobacco leaves, mixing a solvent and various additives therewith to produce a slurry, drying the slurry to form a sheet, and then processing the sheet. For example, the smoking material 221 may include a plurality of reconstituted tobacco material strands, and each strand may have a length in a range of about 10 mm to 14 mm (for example, 12 mm), a width in a range of about 0.8 mm to 1.2 mm (for example, 1 mm), and a thickness in a range of about 0.08 mm to 0.12 mm (for example, 0.1 mm), but the present disclosure is not limited thereto.

In some embodiments, glycerin and a combustion improver such as K-citrate and/or Na-citrate, which is configured to promote complete combustion of a smoking material by a catalytic action or the like, may be added to the wrapper 222, and further, fillers such as calcium carbonate, titanium dioxide, and magnesium oxide may be included in the wrapper 222.

Also, in some embodiments, the wrapper 222 may have a double wrapping structure. Specifically, the wrapper 222 may include an inner wrapper that comes in contact with the smoking material portion 22 and wrapped around the smoking material portion 22 and an outer wrapper that comes in contact with the inner wrapper and wrapped around the outside of the inner wrapper.

Also, in some embodiments, the wrapper 222 may be low ignition propensity (LIP) cigarette paper having one or more LIP bands (not illustrated) formed therein. The LIP band may lower the porosity of the wrapper 222, and accordingly, when combustion of the smoking material 221 reaches the LIP band, an amount of oxygen entering the smoking material portion 22 may decrease, and the smoking article 2, which is burning, may be extinguished. Here, the LIP band may be a coating layer formed on an inner side surface and/or an outer side surface of the wrapper 222.

As mentioned above, the filter portion 21 wrapped by the filter wrapper 212 and the smoking material portion 22 wrapped by the wrapper 222 may be wrapped together by the tipping wrapper 23. That is, the tipping wrapper 23 may be wrapped around at least a portion (for example, a partial downstream region) of the wrapper 222 and an outer periphery of the filter wrapper 212. Meanwhile, the tipping wrapper 23 may include an incombustible material and prevent a phenomenon in which, as the smoking material portion 22 is combusted, the filter portion 21 is also combusted.

The smoking article 2 according to some embodiments of the present disclosure has been described above with reference to FIG. 5. The flavor expressing property and flavor persistence of the smoking article 2 may be significantly improved when the filter 1, to which a flavoring liquid is added, is applied to the smoking article 2. This will be further described below by referring to Experimental Example 4. As mentioned above, when the filter 1, to which a moisturizing material is added, is applied to the smoking article 2, vapor production of the smoking article 2 may be enhanced.

Hereinafter, the configurations and effects of the above-described filter 1 will be described in more detail using examples and comparative examples. However, the following examples are only some examples of the filter 1, and the scope of the present disclosure is not limited to the examples.

EXAMPLE 1

A filter rod having a circumference of 23.8 mm and a length of 96 mm was manufactured according to conditions shown in Table 1 below. A wrapper having a basis weight of 21 gsm was used as a wrapper of the filter rod, and a ratio in a plug (%) is a ratio of an area of a filter material with respect to an entire area of a filter plug and is related to the filter material content. Also, paper whose bulk is 2.40 $cm^3/g$ was used as the filter material.

TABLE 1

| Classification | Details | Remarks |
|---|---|---|
| Filter material | Paper | Bulk: 2.40 $cm^3/g$<br>Matrix structure |
| Ratio in plug (%) | 10 | — |
| Solvent | MCTG | Hydrophobic |
| Flavoring material | Menthol | — |

Comparative Example 1

A filter rod having a circumference of 23.8 mm and a length of 96 mm was manufactured according to conditions shown in Table 2 below. As in Example 1, a wrapper having a basis weight of 21 gsm was used as a wrapper of the filter rod.

TABLE 2

| Classification | Details | Remarks |
|---|---|---|
| Filter material | Cellulose acetate tow | Denier 3.0Y 35,000 |
| Ratio in plug (%) | 10 | — |
| Solvent | PG | Hydrophilic |
| Flavoring material | Menthol | — |

Experimental Example 1: Comparison of Maximum Accommodation Amount (Added Amount) of Flavoring Liquid For the filter rods according to Example 1 and Comparative Example 1, an experiment was conducted to measure the maximum accommodation amount (e.g., the maximum added amount per mm) of the flavoring liquid. The maximum accommodation amount of the flavoring liquid was measured on the basis of whether the wrapper of the filter rod became wet, and whether the wrapper became wet was determined by visual inspection. The results relating to this experimental example are shown in Table 3 below.

TABLE 3

| Classification | Comparative Example 1 | Example 1 |
|---|---|---|
| Maximum added amount (mg/mm) | 1.0 | 6.0 |

As shown in Table 3 above, it can be seen that, despite the same filter material content, the amount of accommodated flavoring liquid of Example 1 is about 6 times higher than that of Comparative Example 1. This indicates that a high-bulk cellulose material in which pores are developed can accommodate a significantly larger amount of flavoring liquid than a cellulose acetate fiber. Also, this indicates that, in terms of flavor expressing property, smoking articles to which the high-bulk cellulose material is applied are superior to conventional smoking articles (that is, smoking articles to which the cellulose acetate tow is applied).

EXAMPLES 2 TO 8

A filter rod was manufactured according to conditions shown in Table 4 below. Other conditions (e.g., bulk and circumference, length, and the like of filter rod) were the same as in Example 1. Also, PG was used as a solvent of a flavoring liquid in the cases of Examples 2 to 4, and MCTG was used as a solvent of a flavoring liquid in the cases of Examples 5 to 8.

TABLE 4

| Classification | Amount of added flavoring liquid (mg/mm) | Flavoring material content(wt %) |
|---|---|---|
| Example 2 | 2 | 70 |
| Example 3 | 3 | 70 |
| Example 4 | 4 | 70 |
| Example 5 | 2 | 40 |
| Example 6 | 3 | 40 |
| Example 7 | 4 | 40 |
| Example 8 | 6 | 40 |

Comparative Example 2

A filter rod having the same conditions as in Example 1 (excluding the flavoring liquid condition) was manufactured without adding a flavoring liquid.

Experimental Example 2: Comparison of Changes in Physical Properties of Filter According to Flavoring Material Content As mentioned above, when a flavoring material content with respect to a solvent is too high, the flavoring material may be precipitated in a solid phase again and cause physical properties of the filter to be changed. Therefore, there is a need to appropriately control the flavoring material content. For this, changes in physical properties (e.g., circumference, draw resistance, hardness) of the filter rods according to Examples 2 to 8 and Comparative Example 2 were measured.

For reference, Comparative Example 2 was added in order to take into account the measurement error, and the cellulose acetate tow-based filter was not added as a comparative example because it is not possible to add the same amount of flavoring liquid to cellulose acetate tow, and thus the cellulose acetate tow-based filter is not suitable for use as a comparative example.

Experimental Example 2-1: Comparison of Physical Property Changes Relating to Circumference An experiment was conducted to measure a degree of change in a circumferential length of the filter rods. For accuracy of the experiment, the measurement was not performed after reaching a time point when the flavoring liquid no longer affects the physical properties of the filter (when about 14 days have elapsed), and a physical property difference between that time point and a time point before adding the flavoring liquid was measured. The experimental results thereof are shown in Tables 5 and 6 below.

TABLE 5

| Classification | Comparative Example 2 | Example 2 | Example 3 | Example 4 |
|---|---|---|---|---|
| Before adding | 23.75 | 23.65 | 23.76 | 23.70 |
| 1 day elapsed | 23.74 | 23.75 | 23.93 | 23.89 |
| 3 days elapsed | 23.74 | 23.75 | 23.95 | 23.91 |
| 7 days elapsed | 23.76 | 23.76 | 24.00 | 23.93 |
| 14 days elapsed | 23.76 | 23.78 | 23.97 | 23.99 |
| Degree of change | +0.01 | +0.13 | +0.23 | +0.29 |

TABLE 6

| Classification | Example 5 | Example 6 | Example 7 | Example 8 |
|---|---|---|---|---|
| Before adding | 23.70 | 23.70 | 23.75 | 23.70 |
| 1 day elapsed | 23.70 | 23.70 | 23.70 | 23.70 |
| 3 days elapsed | 23.72 | 23.75 | 23.70 | 23.70 |
| 7 days elapsed | 23.71 | 23.72 | 23.75 | 23.70 |
| 14 days elapsed | 23.71 | 23.70 | 23.76 | 23.70 |
| Degree of change | +0.01 | +0.00 | +0.01 | 0.0 |

Referring to Tables 5 and 6, it can be seen that, when the flavoring material content is 40 wt % (Examples 5 to 8), the circumference of the filter rod hardly changes even when the amount of added flavoring liquid is increased. For example, even when the flavoring material content is 40 wt % and the amount of added flavoring liquid is 6 mg/mm (Example 8), no difference was found before and after adding the flavoring liquid. This shows that, when a hydrophilic cellulose material is used as the filter material, swelling thereof due to the flavoring liquid hardly occurs.

On the other hand, when the flavoring material content is 70 wt % (Examples 2 to 4), it was found that a change in the circumference of the filter rod increased with an increase in the amount of added flavoring liquid. However, this is analyzed to be due to the flavoring material being precipitated in a solid phase in between portions of the filter material, rather than being due to swelling.

Experimental Example 2-2: Comparison of Physical Property Changes Relating to Draw Resistance An experiment was conducted to measure a degree of change in draw resistance of the filter rods. The experiment was conducted in the same manner as in the previous experimental example, and the experimental results are shown in Tables 7 and 8 below.

TABLE 7

| Classification | Comparative Example 2 | Example 2 | Example 3 | Example 4 |
|---|---|---|---|---|
| Before adding | 176 | 180 | 176 | 182 |
| 1 day elapsed | 172 | 211 | 282 | 240 |
| 3 days elapsed | 176 | 239 | 328 | 344 |
| 7 days elapsed | 177 | 204 | 279 | 298 |
| 14 days elapsed | 182 | 251 | 277 | 307 |
| Degree of change | +6 | +71 | +101 | +125 |

TABLE 8

| Classification | Example 5 | Example 6 | Example 7 | Example 8 |
|---|---|---|---|---|
| Before adding | 176 | 180 | 176 | 176 |
| 1 day elapsed | 176 | 178 | 176 | 172 |
| 3 days elapsed | 176 | 178 | 178 | 176 |
| 7 days elapsed | 176 | 179 | 179 | 177 |

TABLE 8-continued

| Classification | Example 5 | Example 6 | Example 7 | Example 8 |
|---|---|---|---|---|
| 14 days elapsed | 175 | 180 | 178 | 182 |
| Degree of change | −1 | 0 | +2 | +6 |

Referring to Tables 7 and 8, it can be seen that, when the flavoring material content is 40 wt % (Examples 5 to 8), the draw resistance of the filter rod hardly changes even when the amount of added flavoring liquid is increased. For example, even when the flavoring material content is 40 wt % and the amount of added flavoring liquid is 6 mg/mm (Example 8), almost no difference was found before and after adding the flavoring liquid. This is determined to be due to the cellulose material being able to accommodate a large amount of flavoring liquid and the content ratio between the solvent and the flavoring material being appropriate such that the flavoring material maintains a liquid phase (that is, a dissolved state) even at room temperature.

On the other hand, when the flavoring material content is 70 wt % (Examples 2 to 4), it was found that the draw resistance of the filter rod gradually increased with an increase in the amount of added flavoring liquid. This is analyzed to be a phenomenon that occurs due to the high-content flavoring material being precipitated in a solid phase in between portions of the filter material.

Experimental Example 2-3: Comparison of Physical Property Changes Relating to Hardness An experiment was conducted to measure a degree of change in hardness of the filter rods. The overall experiment was conducted in the same manner as in the previous experimental example, and the hardness of the filter rod was measured on the basis of Equation 1 below.

Equation 1 below is an equation for obtaining the hardness of the filter rod in percentage (%). In Equation 1 below, D represents a thickness (e.g., diameter) of the rod before a load (F) is applied thereto (that is, the rod in an unpressed state), and $D_F$ represents a thickness of the rod after the load is applied thereto (that is, the rod in a pressed state). According to Equation 1 below, the harder the rod (that is, the lower the extent to which the rod is pressed), the closer the hardness is to 100%.

$$\text{Hardness } (\%) = D_F/D \times 100 \qquad \text{[Equation 1]}$$

The hardness of the filter rod was calculated by applying a weight load of about 300 g weight thereto for about 20 seconds and measuring the thickness of the filter rod before and after the load was applied thereto. For reference, a known densimeter device may be used for the measurement, but the hardness measurement may also be performed in other ways. The experimental results according to this experimental example are shown in Tables 9 and 10.

TABLE 9

| Classification | Comparative Example 2 | Example 2 | Example 3 | Example 4 |
|---|---|---|---|---|
| Before adding | 91.8 | 87.9 | 89.6 | 89.2 |
| 1 day elapsed | 91.6 | 90.5 | 92.7 | 91.2 |
| 3 days elapsed | 91.3 | 90.7 | 92.8 | 91.5 |
| 7 days elapsed | 91.5 | 90.5 | 94.2 | 92.3 |
| 14 days elapsed | 91.7 | 90.7 | 93.0 | 93.1 |
| Degree of change | −0.1 | +2.1 | +3.4 | +3.9 |

TABLE 10

| Classification | Example 5 | Example 6 | Example 7 | Example 8 |
|---|---|---|---|---|
| Before adding | 91.4 | 91.5 | 91.0 | 91.1 |
| 1 day elapsed | 91.6 | 91.6 | 91.2 | 91.2 |
| 3 days elapsed | 91.3 | 91.3 | 91.2 | 91.3 |
| 7 days elapsed | 91.5 | 91.5 | 91.3 | 91.2 |
| 14 days elapsed | 91.3 | 91.5 | 91.1 | 91.1 |
| Degree of change | −0.1 | 0.0 | +0.1 | 0.0 |

Referring to Tables 9 and 10, it can be seen that, when the flavoring material content is 40 wt % (Examples 5 to 8), the hardness of the filter rod hardly changes even when the amount of added flavoring liquid is increased. This is analyzed to be due to the content ratio between the solvent and the flavoring material being appropriate such that the flavoring material maintains a liquid phase (that is, a dissolved state) even at room temperature.

On the other hand, when the flavoring material content is 70 wt % (Examples 2 to 4), it was found that the hardness of the filter rod gradually increased with an increase in the amount of added flavoring liquid. This is analyzed to be a phenomenon that occurs as the high-content flavoring material is precipitated in a solid phase in between portions of the filter material.

Summarizing the experimental results according to Experimental Example 2, it can be seen that the content ratio between the flavoring material (e.g., a flavoring material that is present as a crystalline solid at room temperature) and the solvent affects the physical properties of the filter. Also, it can be seen that, when the flavoring material content is 40 wt %, the physical properties of the filter hardly change, and when the flavoring material content is 70 wt %, the changes in the physical properties of the filter gradually increased with an increase in the amount of added flavoring liquid. Thus, preferably, in the flavoring liquid, the flavoring liquid content may be less than or equal to 70 wt %, and in order to minimize changes in the physical properties of the filter, preferably, the flavoring material content may be less than or equal to about 60 wt % or 50 wt %.

EXAMPLES 9 TO 12

A filter rod was manufactured according to conditions shown in Table 11 below. Other conditions (e.g., bulk and circumference, length, and the like of filter rod) were the same as in Example 1. In Table 11, "paper width" refers to a vertical length of paper. For example, the filter rod according to Example 9 was manufactured using paper having a size of 96 mm (=horizontal length of filter rod)×220 mm as the filter material.

TABLE 11

| Classification | Amount of added flavoring liquid (mg/mm) | Flavoring material content (wt %) | Paper width (mm) |
|---|---|---|---|
| Example 9 | 6 | 40 | 220 |
| Example 10 | 6 | 40 | 250 |
| Example 11 | 6 | 40 | 280 |
| Example 12 | 6 | 40 | 310 |

Experimental Example 3: Experiment for Comparing Changes in Physical Properties According to Paper Width of Filter Material An in-depth experiment was conducted using a filter rod in which the amount of added flavoring liquid was 6 mg/mm and the flavoring material content was 40 wt %. Specifically, an experiment was conducted to observe whether major physical properties (i.e., circumference and draw resistance) of the filter is maintained without change even when the paper width of the filter material (that is, filter material content) changes under the same flavoring liquid condition, and the experiment was conducted in the same manner as in the previous experimental example.

The experimental results according to this experimental example are shown in Tables 12 and 13 below. Table 12 below shows results of measuring the circumference, and Table 13 shows results of measuring draw resistance.

TABLE 12

| Classification | Example 9 | Example 10 | Example 11 | Example 12 |
|---|---|---|---|---|
| Before adding | 23.6 | 23.7 | 23.6 | 23.7 |
| 1 day elapsed | 23.7 | 23.8 | 23.6 | 23.7 |
| 3 days elapsed | 23.7 | 23.8 | 23.6 | 23.7 |
| 7 days elapsed | 23.7 | 23.8 | 23.6 | 23.7 |
| 14 days elapsed | 23.7 | 23.8 | 23.6 | 23.7 |
| Degree of change | +0.01 | +0.01 | 0.0 | 0.0 |

TABLE 13

| Classification | Example 9 | Example 10 | Example 11 | Example 12 |
|---|---|---|---|---|
| Before adding | 137 | 212 | 327 | 476 |
| 1 day elapsed | 136 | 223 | 343 | 480 |
| 3 days elapsed | 136 | 223 | 342 | 479 |
| 7 days elapsed | 136 | 222 | 339 | 471 |
| 14 days elapsed | 136 | 224 | 344 | 482 |
| Degree of change | −1 | +12 | +17 | +6 |

Referring to Tables 12 and 13, it can be seen that, when the flavoring material content is 40 wt %, an increase in the paper width of the filter material (that is, an increase in the filter material content) hardly affected the physical properties (i.e., circumference and draw resistance) of the filter rod. However, when the paper width increases, since default draw resistance also increases simultaneously as the filter performance of the filter rod is improved and the amount of accommodated flavoring liquid is increased, there is a need to appropriately control the paper width by considering such factors comprehensively.

Experimental Example 4: Sensory Evaluation Relating to Flavor Expressing Property and Flavor Persistence Sensory evaluation relating to flavor expressing property and flavor persistence was performed by a panel of thirty evaluators who have smoked for five years or more. Specifically, smoking articles were manufactured using the filter rods according to Comparative Example 1 and Examples 5 to 8, and a flavor intensity according to puff number was measured for the manufactured smoking articles. The sensory evaluation was performed on the basis of the five ratings below, and in order to reduce the evaluation error, the lowest and highest ratings were excluded from the evaluation result, and the average rating given by the panel was calculated as the flavor intensity of the corresponding smoking article.

5: Strong
4: Slightly strong
3: Moderate
2: Slightly weak
1: Weak

The results according to this experimental example are illustrated in FIG. 6. On the graph of FIG. 6, the x-axis represents the puff number, and the y-axis represents the flavor intensity.

Referring to FIG. 6, it can be seen that, in the case of the smoking article according to Comparative Example 1, the flavor expressing property sharply decreased toward the end of smoking. This is determined to be due to the structural characteristics of cellulose acetate tow not being able to suppress the volatilization of the flavoring material.

On the other hand, it can be seen that, in the cases of the smoking articles according to Examples 5 to 8, the flavor expressing property did not sharply decrease and a flavor at a predetermined level or higher was continuously expressed. This is analyzed to be due to the high-bulk cellulose material and MCTG suppressing the volatilization of the flavoring material.

In particular, it was found that, in the smoking articles according to Examples 7 and 8, a flavor having an intensity rating of 3 or higher was continuously expressed. This is analyzed to be due to a larger amount of added flavoring liquid as compared to other smoking articles.

Summarizing the above results, it can be seen that, when a flavoring liquid which includes a solvent and a flavoring material in an appropriate content ratio is added to a cellulose material, smoking articles with a significantly better flavor expressing property and significantly better flavor persistence as compared to cellulose acetate tow-based smoking articles can be manufactured without affecting the physical properties of the filter.

The configurations and effects of the filter 1 according to embodiments of the present disclosure have been described in detail above using various examples and comparative examples.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. A smoking article filter comprising:

a filter plug including a filter material having a pore structure and a liquid material added to the filter material; wherein the liquid material is added to the filter material by spraying, wherein the liquid material is accommodated within the pore structure of the filter material, wherein the filter material is a material in which a molecular weight of a hydrophilic group is larger than or equal to a molecular weight of a hydrophobic group, wherein the filter material includes a cellulose material whose bulk is 2.4 $cm^3/g$, wherein the liquid material is a flavoring liquid including a medium chain fatty acid triglyceride (MCTG) and a flavoring material, the flavoring material is a material that is present as a crystalline solid at 20° C., a content of the flavoring material in the flavoring liquid is 40 wt %, and an added amount of the liquid material is in a range of 2.0 mg/mm to 6.0 mg/mm, wherein the added amount of the liquid material is defined as an amount added per unit length of the filter plug with a circumference of 23.8 mm.

2. The smoking article filter of claim 1, wherein:

the filter material consists of a plurality of polymerized monomers; and a molecular weight of hydrophilic groups of the monomers is larger than or equal to a molecular weight of hydrophobic groups thereof.

3. The smoking article filter of claim 1, wherein the filter material includes paper.

4. The smoking article filter of claim 1, wherein the liquid material is hydrophobic.

5. The smoking article filter of claim 1, wherein the flavoring material includes menthol.

6. The smoking article filter of claim 1, wherein a difference between a circumference of the filter plug formed of the filter material to which the liquid material is added and a circumference of the filter plug formed of the filter material before the liquid material is added is less than or equal to 10% of the circumference of the filter plug formed of the filter material before the liquid material is added.

7. The smoking article filter of claim 1, wherein a difference between a draw resistance of the filter plug formed of the filter material to which the liquid material is added and a draw resistance of the filter plug formed of the filter material before the liquid material is added is less than or equal to 15% of the draw resistance of the filter plug formed of the filter material before the liquid material is added.

* * * * *